US006390107B1

(12) United States Patent
Lin et al.

(10) Patent No.: US 6,390,107 B1
(45) Date of Patent: May 21, 2002

(54) DOUBLE-STORY UMBRELLA

(75) Inventors: Chung-Kuang Lin; Jung-Jen Chang, both of Taipei Hsien (TW)

(73) Assignee: Fu Tai Umbrella Works Ltd., Taipei Hsien (TW)

( * ) Notice: Subject to any disclaimer, the term of this patent is extended or adjusted under 35 U.S.C. 154(b) by 8 days.

(21) Appl. No.: 09/727,576

(22) Filed: Dec. 4, 2000

(51) Int. Cl.[7] ..... A45B 15/00; A45B 17/00; A45B 23/00

(52) U.S. Cl. ..... 135/25.4; 135/25.1; 135/15.1; 135/98

(58) Field of Search ..... 135/25.4, 25.1, 135/15.1, 98, 33.7

(56) References Cited

U.S. PATENT DOCUMENTS 5,678,586 A * 10/1997 Baksh ..... 135/33.7
6,318,391 B1 * 11/2001 You ..... 135/33.7

FOREIGN PATENT DOCUMENTS

FR 392568 * 11/1908 ..... 135/33.7
FR 40613 * 7/1932 ..... 135/33.7

* cited by examiner

*Primary Examiner*—Robert Canfield
(74) *Attorney, Agent, or Firm*—Troxell Law Office PLLC

(57) ABSTRACT

A double-story umbrella includes an upper umbrella, and a lower umbrella detachably coupled with the upper umbrella and operatively opened to be a beach umbrella or a big umbrella having large shielding area; whereby upon uncoupling of the upper and lower umbrellas, each umbrella can be folded to have a short folding length for a convenient handling and storage when the umbrella is folded.

20 Claims, 12 Drawing Sheets

DOUBLE-STORY UMBRELLA

BACKGROUND OF THE INVENTION

A conventional beach umbrella includes a large-diameter umbrella cloth secured on a rib assembly having large diameter for shielding sunlight. However, the umbrella cloth having large diameter up to 1.5 meters will occupy a large space after being folded, which is inconvenient for handling and storage especially when stored in a small car.

The present inventor has found the drawbacks of the conventional beach umbrella and invented the present double-story umbrella.

SUMMARY OF THE INVENTION

The object of the present invention is to provide a double-story umbrella including an upper umbrella, and a lower umbrella detachably coupled with the upper umbrella and operatively opened to be a beach umbrella or a big umbrella having large shielding area; whereby upon uncoupling of the upper and lower umbrellas, each umbrella can be folded to have a short folding length for a convenient handling and storage when the umbrella is folded.

DETAILED DESCRIPTION

Figure 1:
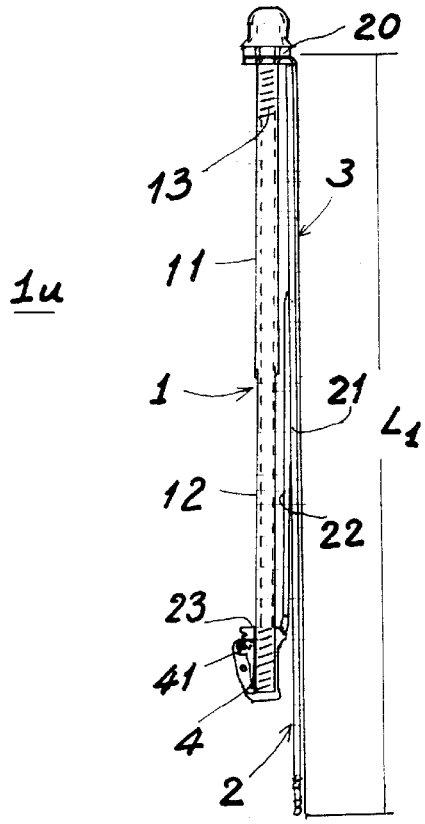
FIG. 1 is an illustration of a folded upper umbrella of the double-story umbrella of the present invention.
Figure 2:
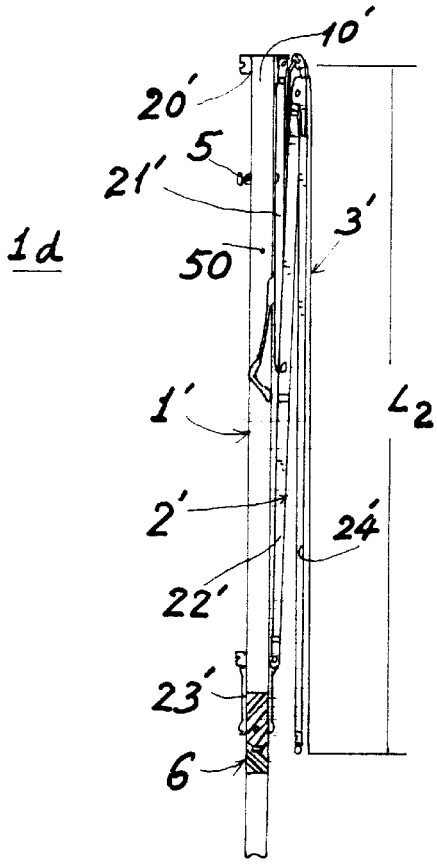
FIG. 2 a folded lower umbrella of the double-story umbrella of the present invention.
Figures 3, 4, 5:
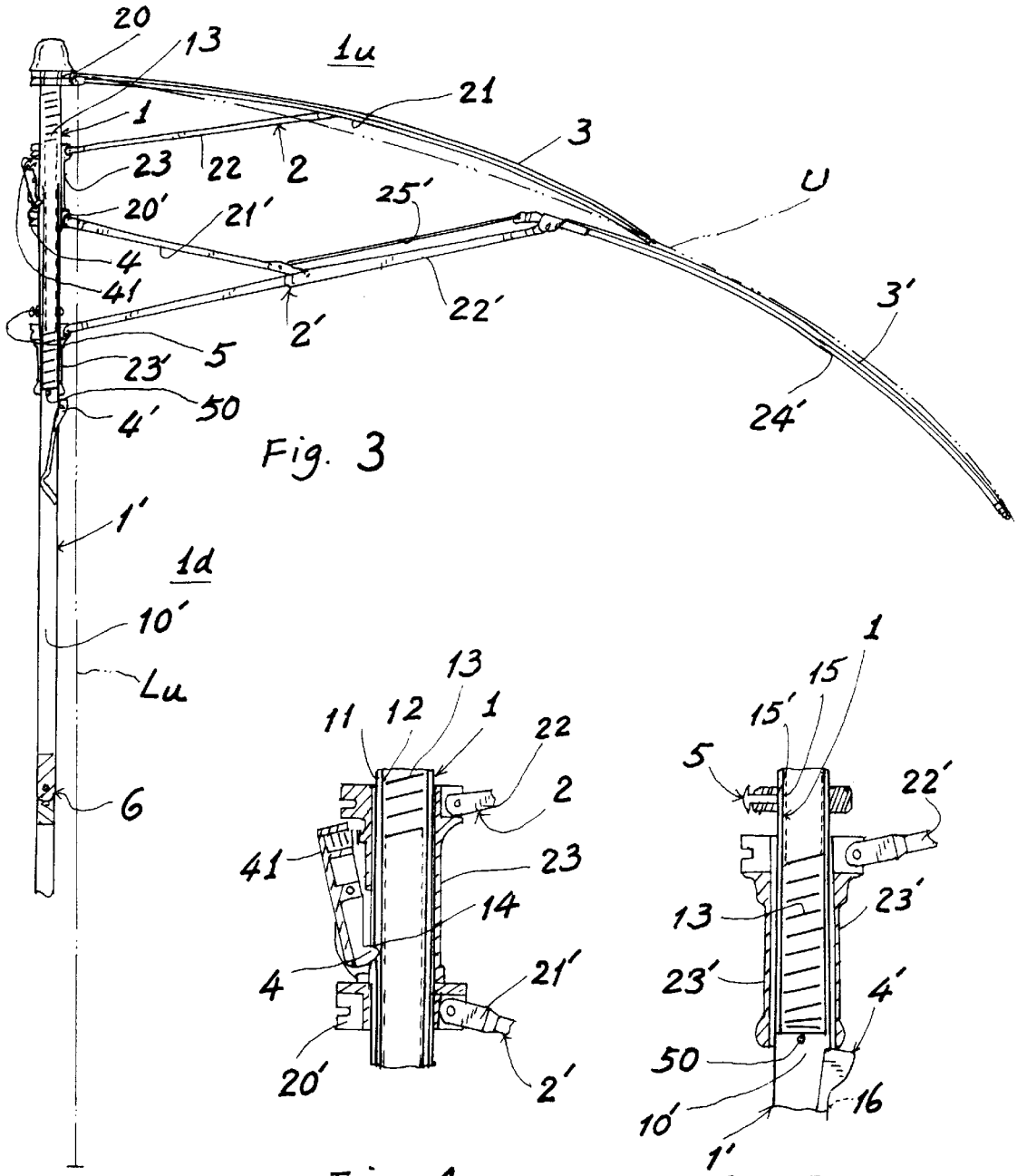
FIG. 3 shows an opened double-story umbrella of the present invention when coupling the upper and lower umbrellas.
FIG. 4 is a partial enlarged illustration of the runner of the upper umbrella and the notch of the lower umbrella.
FIG. 5 shows a coupling for coupling the upper umbrella with the lower umbrella adjacent to the lower runner of the lower umbrella.

As shown in FIGS. 1~8, the double-story umbrella of the present invention comprises: an upper umbrella 1*u* and a lower umbrella 1*d* detachably coupled with the upper umbrella 1*u* to form a double-story umbrella (as shown in FIG. 3) such as a double-story (or two-storied) beach umbrella or umbrella with large diameter for increasing a larger shielding area.

The upper umbrella 1*u* includes: an upper shaft 1, an upper rib assembly 2 pivotally secured to the upper shaft 1, an upper umbrella cloth 3 secured on the upper rib assembly 2, and an upper spring catch 4 resiliently lockable on the upper shaft 1 for locking the upper rib assembly 2 at its opening state (FIG. 3).

The upper shaft 1 includes: an upper tube 11, a lower tube 12 telescopically engageable with the upper tube 11, and a tension spring 13 resiliently held in between the upper tube 11 and the lower tube 12 for normally extending the upper and lower tubes 11, 12 adapted for the sliding movement of a runner 23 on the upper shaft 1.

Naturally, the upper shaft 1 may be a single tube or a multiple-fold shaft including a plurality of tubes telescopically engageable with one another, not limited in the present invention.

The upper rib assembly 2 includes: a top rib 21 pivotally secured to an upper notch 20 formed on a top of the upper shaft 1, and a stretcher rib 22 pivotally secured between the top rib 21 and a runner 23 slidably held on the upper shaft 1.

The upper spring catch 4 is resiliently lockable on the upper shaft 1 as engaged with a catch slot 14 formed in an upper portion of the upper shaft 1 for locking the runner 23 of the upper rib assembly 2 at its extending (or opening) state as shown in FIGS. 3, 4; and further includes a push button 41 for disengaging the upper spring catch 4 from the catch slot 14 in the upper shaft 1 for closing or folding the umbrella (from FIG. 3 to FIG. 1 or 2).

The lower umbrella 1*d* includes: a lower shaft 1', a lower rib assembly 2' pivotally secured to the lower shaft 1', a lower umbrella cloth 3' secured on the lower rib assembly 2', and a lower spring catch 4' resiliently lockable or formed on the lower shaft 1' for locking the lower rib assembly 2' at its opening state (FIG. 3).

A coupling 5 is provided on the lower shaft 1' for coupling the upper shaft 1 on the lower shaft 1' for mounting the upper umbrella 1*u* on the lower umbrella 1*d* when opening the two-story umbrella as shown in FIGS. 3, 5.

The coupling 5 may be a latch, a pin, a screw, a lock, a fastener or any other coupling device provided for connecting the upper shaft 1 above the lower shaft 1', not limited in the present invention.

The lower shaft 1' may be formed as a single tube or as a multiple-fold shaft having a plurality of tubes telescopically engageable with one another.

The lower rib assembly 2' includes: an inner rib 21' pivotally secured to a notch 20' formed on a top of the lower shaft 1', a lower stretcher rib 22' having its inner end pivotally secured to a lower runner 23' slidably held on the lower shaft 1' and having a middle portion of the lower stretcher rib 22' pivotally connected with the inner rib 21', and a lower tail rib 24' pivotally secured to an outer end of the lower stretcher rib 22' and having an innermost end of the lower tail rib 24' pivotally secured to an outer portion of the inner rib 21' by a lower auxiliary rib 25'.

The lower shaft 1' has a hollow interior 10' for inserting the upper shaft 1 into the hollow interior 10' for mounting the upper shaft 1 on the lower shaft 1', with a bottom end of the upper shaft 1 limited or retained at a retainer 50 which may be a pin or other stopping device fixed in the lower shaft 1' as shown in FIGS. 3, 5.

When erecting the two-story umbrella of the present invention for shielding sunlight, for instance, the upper umbrella 1*u* will be first opened by engaging the upper spring catch 4 at a catch slot (or slots) 14 formed in the tubes of the upper shaft 1 and the upper shaft 1 is then inserted into the interior 10' in the lower shaft 1' and the coupling 5 is operated to allow a latch, for instance, of the coupling 5 to engage the latch holes 15', 15 respectively formed in the tubes of the lower shaft 1' and the upper shaft 1 for stably locking the upper shaft 1 with the lower shaft 1' for coupling the upper umbrella 1*u* on the lower umbrella 1*d*. The lower umbrella 1*d* is finally opened by retaining the lower runner 23' on the lower spring catch 4' as engaged with the catch slot 16 formed in the lower shaft 1' as shown in FIGS. 3, 5 to be a two-story umbrella such as a beach umbrella.

After folding or closing the upper and lower umbrellas 1*u*, 1*d*, the upper and lower umbrella 1*u*, 1*d* may be detached or broken down as two pieces to shorten the folding length either of the two umbrellas. So, the folding length Lu as folded from a conventional umbrella cloth U as shown in phantom line of FIG. 3 can be greatly minimized since either the folding length L1 of the upper umbrella 1*u* (FIG. 1) or the folding length L2 of the lower umbrella 1*d* (FIG. 2) after being uncoupled and broken down is much less than the folding length Lu of the conventional umbrella cloth U (FIG. 3, phantom line) which is not formed as two stories including an upper umbrella and a lower umbrella as disclosed in the present invention.

The shortened folding length (L1 or L2) of the two umbrellas 1*u*, 1*d* of the present invention will enhance a more convenient handling and storage of a folded umbrella, for instance, for a convenient storage into a tiny space within a car.

The present invention including two-story umbrella consisting of an upper umbrella and a lower umbrella which may be assembled or detached conveniently to be superior to a conventional beach umbrella or an umbrella with large diameter.

Figures 6, 7, 8:
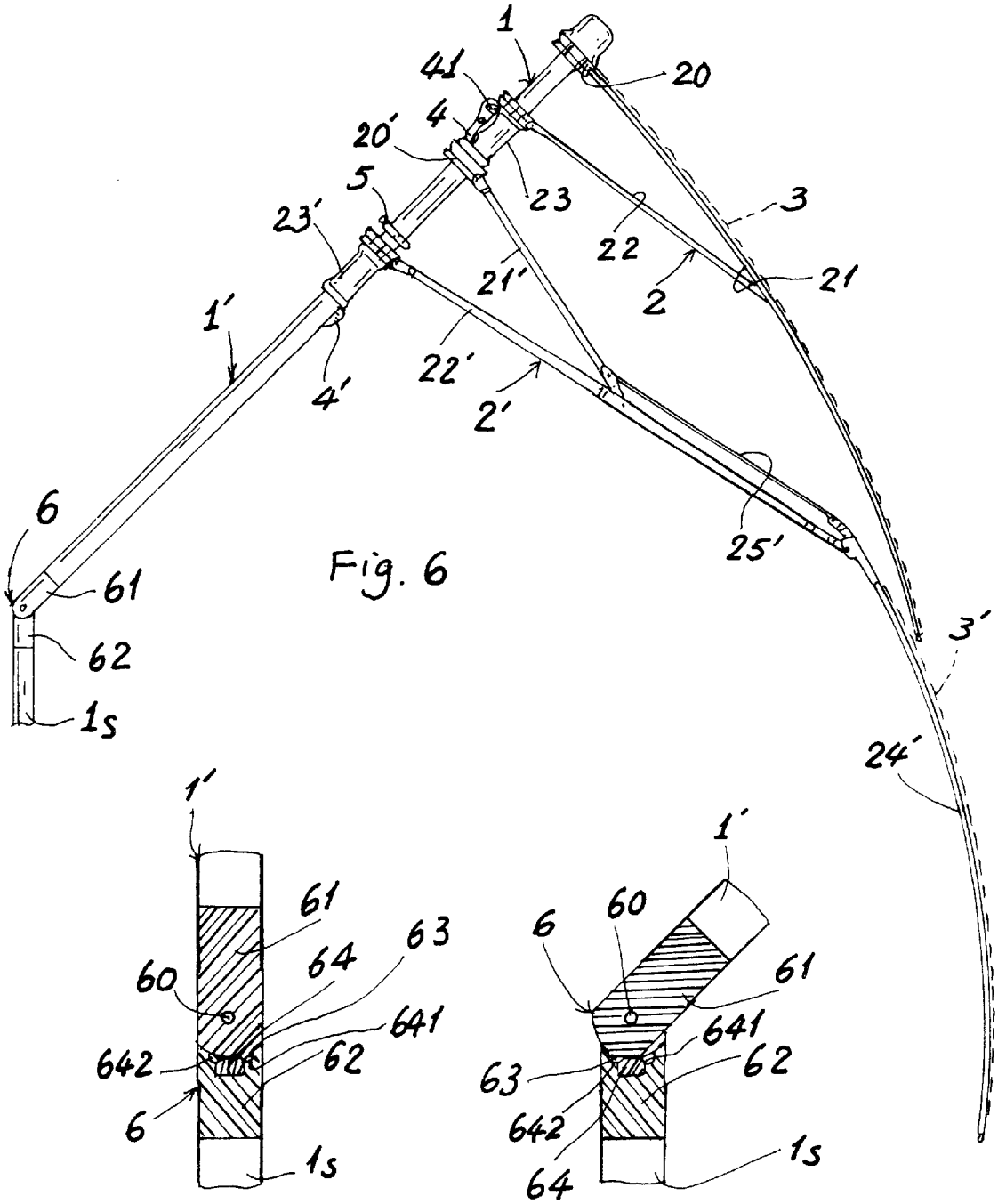
FIG. 6 shows the double-story umbrella of the present invention when tilted.
FIG. 7 shows an angle-adjusting means of the present invention when vertically erecting the shaft of the umbrella.
FIG. 8 shows the angle-adjusting means when tilting the shaft of the umbrella.

As shown in FIGS. 6~8, the present invention further comprises an angle-adjusting means 6 for tilting the umbrella shaft at an optimum angle in order to obtain a better shielding effect.

The angle-adjusting means 6 may be integrally formed with the shaft of the present invention or may be an additional unit (like a spare part) securable with the shaft of the present invention.

The angle-adjusting means 6 includes: an upper member 61 secured to (or formed on) a bottom portion of the lower shaft 1' of the lower umbrella 1*d*; a lower member 62 secured to (or formed on) a base (or base stand) 1*s* and pivotally secured to the upper member 61 by a pivot 60; a protrusion 63 formed on a bottom (such as a bottom right portion in FIG. 7) of the upper member 61; and a positioning pad 64 formed on an upper end of the lower member 62 having a first recess 641 recessed in a first position (such as a right portion) on the positioning pad 64 for engaging the protrusion 63 of the upper member 61 (secured to the umbrella shaft 1', 1) with the first recess 641 for erecting the umbrella shaft at a first angle (such as a vertical angle as shown in FIG. 7), and having a second recess 642 recessed in a second position (such as a left portion) on the positioning pad 64 for engaging the protrusion 63 with the second recess 642 for erecting the umbrella shaft at a second angle (such as a rightward tilting angle as shown in FIG. 8).

Figure 9:
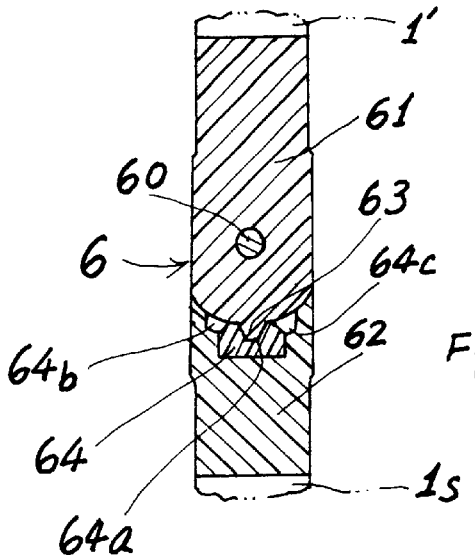
FIG. 9 shows another preferred example of the angle-adjusting means when vertically erecting the umbrella shaft.
Figure 10:
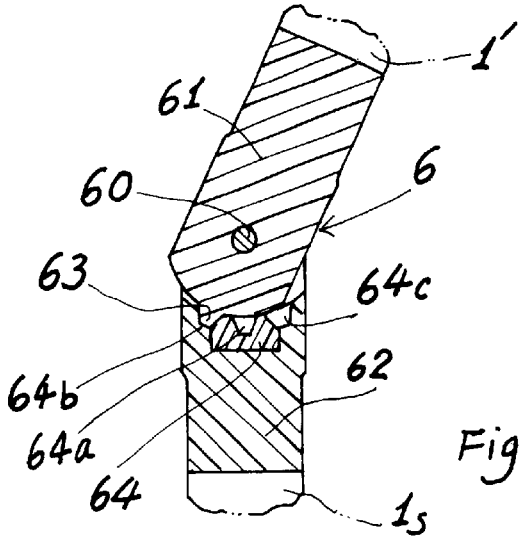
FIG. 10 shows the angle-adjusting means when rightwardly tilting the shaft.
Figure 11:
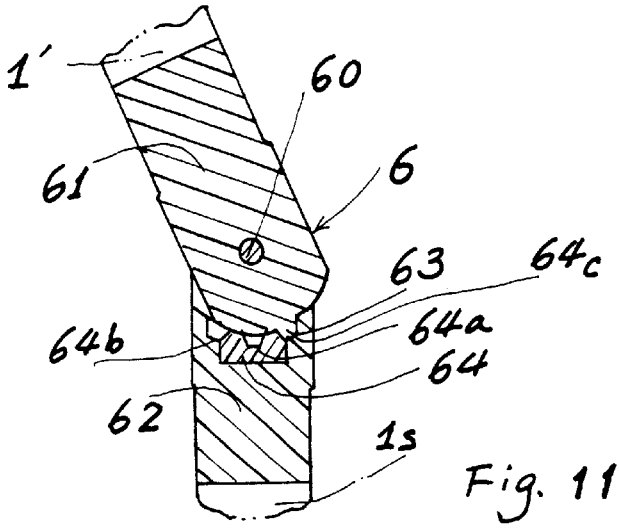
FIG. 11 shows the angle-adjusting means when leftwardly tilting the shaft.

As shown in FIGS. 9~11, the protrusion 63 is formed on a central bottom portion of the upper member 61, while the positioning pad 64 is formed with a middle recess 64*a*, a left recess 64*b* and a right recess 64*c* respectively recessed in a central, left and right portion of the positioning pad 64 for selectively engaging the protrusion 63 with the middle recess 64*a* for vertically erecting the upper member 61 and the umbrella shaft 1' as shown in FIG. 9; or for engaging the protrusion 63 with the left recess 64*b* for rightwardly tilting the upper member 61 and the umbrella shaft 1' as shown in FIG. 10; or for engaging the protrusion 63 with the right recess 64*c* for leftwardly tilting the upper member 61 and the umbrella shaft 1' as shown in FIG. 11.

Figure 16:
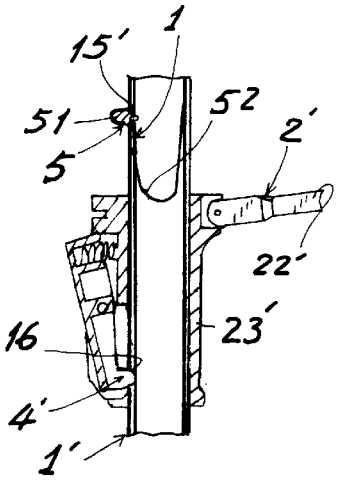
FIG. 16 shows the coupling for coupling the upper umbrella on the lower umbrella of FIG. 14.
Figure 17:
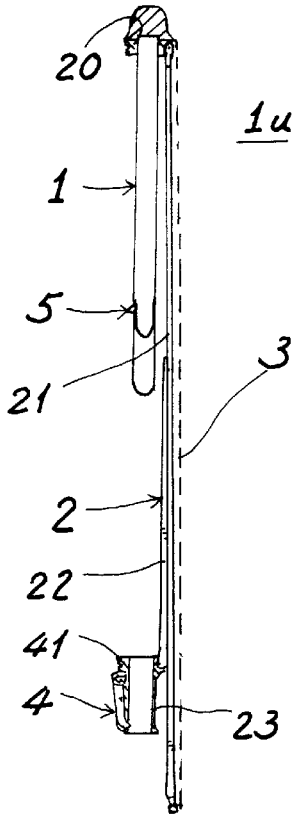
FIG. 17 shows a folded upper umbrella of still another preferred embodiment of the present invention.
Figure 18:
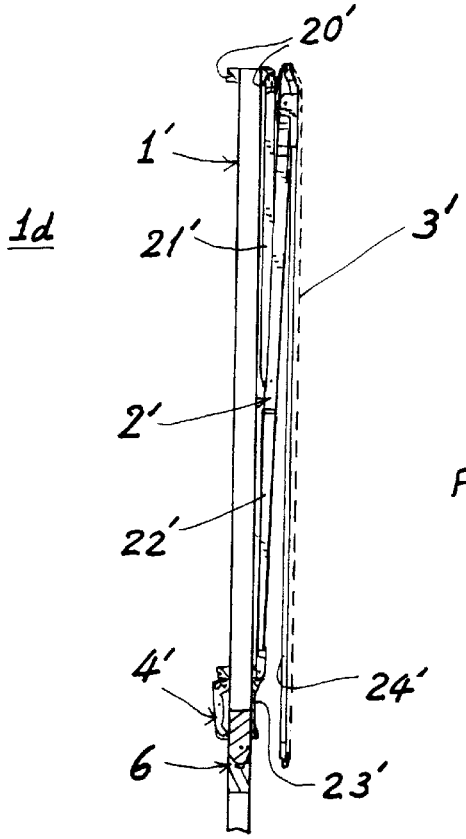
FIG. 18 shows a folded lower umbrella of the still another preferred embodiment of the present invention.
Figures 19, 20, 21:
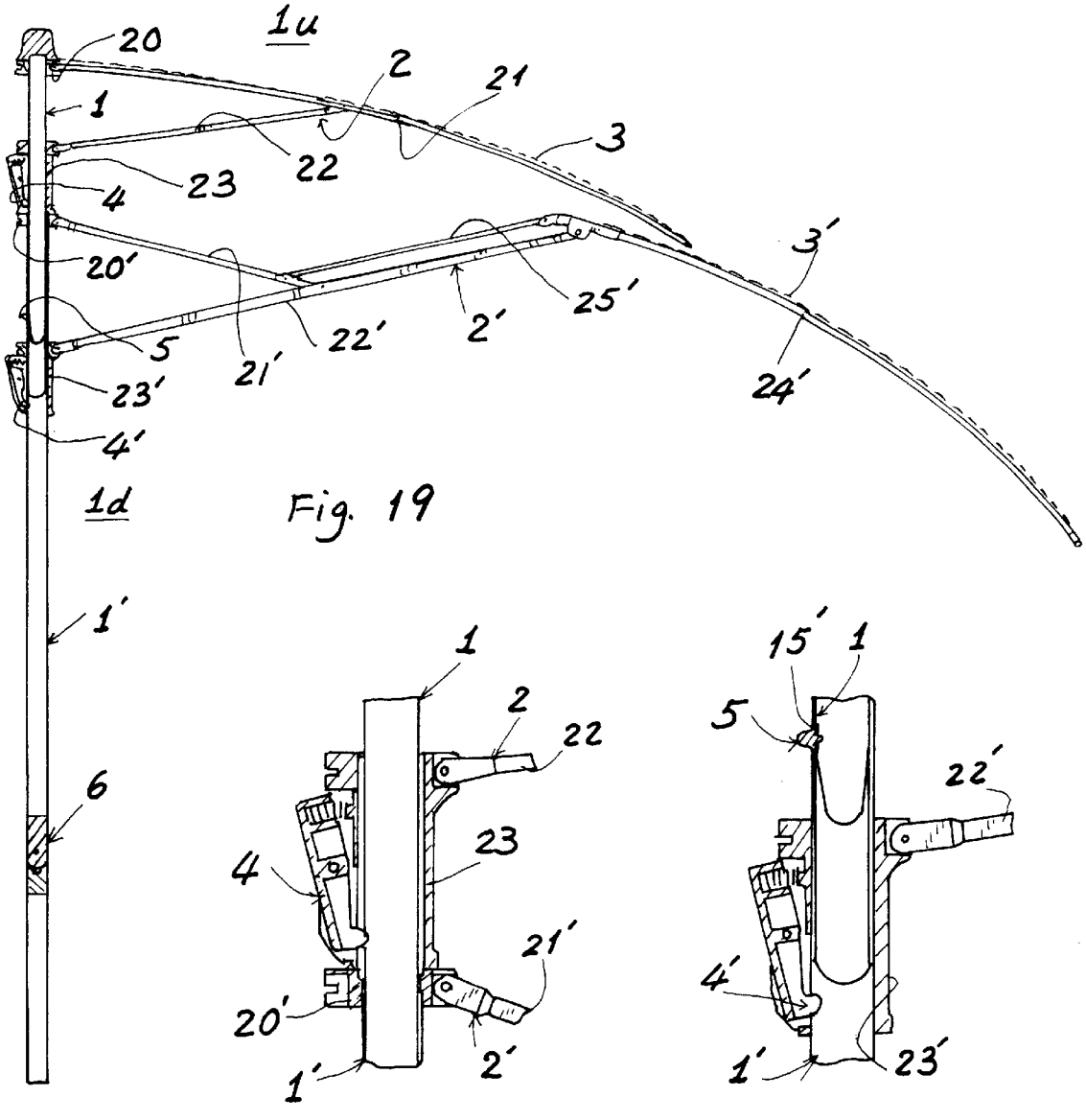
FIG. 19 shows an open umbrella when coupling the upper and lower umbrellas as shown in FIGS. 17, 18.
FIG. 20 shows the runner of the upper umbrella and the notch of the lower umbrella of FIG. 19.
FIG. 21 shows the coupling for coupling the upper and lower umbrellas as shown in FIG. 19.

As shown in FIGS. 12~16, the upper umbrella 1*u* includes an upper rib assembly 2 of two folds pivotally secured to the upper shaft 1 as modified from the first embodiment as shown in FIGS. 1~5; and the lower umbrella 1*d* having the lower spring catch 4' resiliently formed on the lower runner 23' as modified from the foregoing embodiment for engaging the lower spring catch 4' with the catch slot 16 formed in the lower shaft 1' as shown in FIG. 16 when opening the lower umbrella 1*d*.

The upper rib assembly 2 of the upper umbrella 1*u* includes: a top rib 21 pivotally secured to an upper notch 20 on a top of the upper shaft 1, a stretcher rib 22 having its inner end pivotally secured to the runner 23 slidably held on the upper shaft 1 and having a middle portion of the stretcher rib 22 pivotally secured to the top rib 21, a tail rib 24 pivotally secured to an outer end of the stretcher rib 22 and having an innermost end of the tail rib 24 pivotally secured to the top rib 21 through an auxiliary rib 25.

Figure 14:
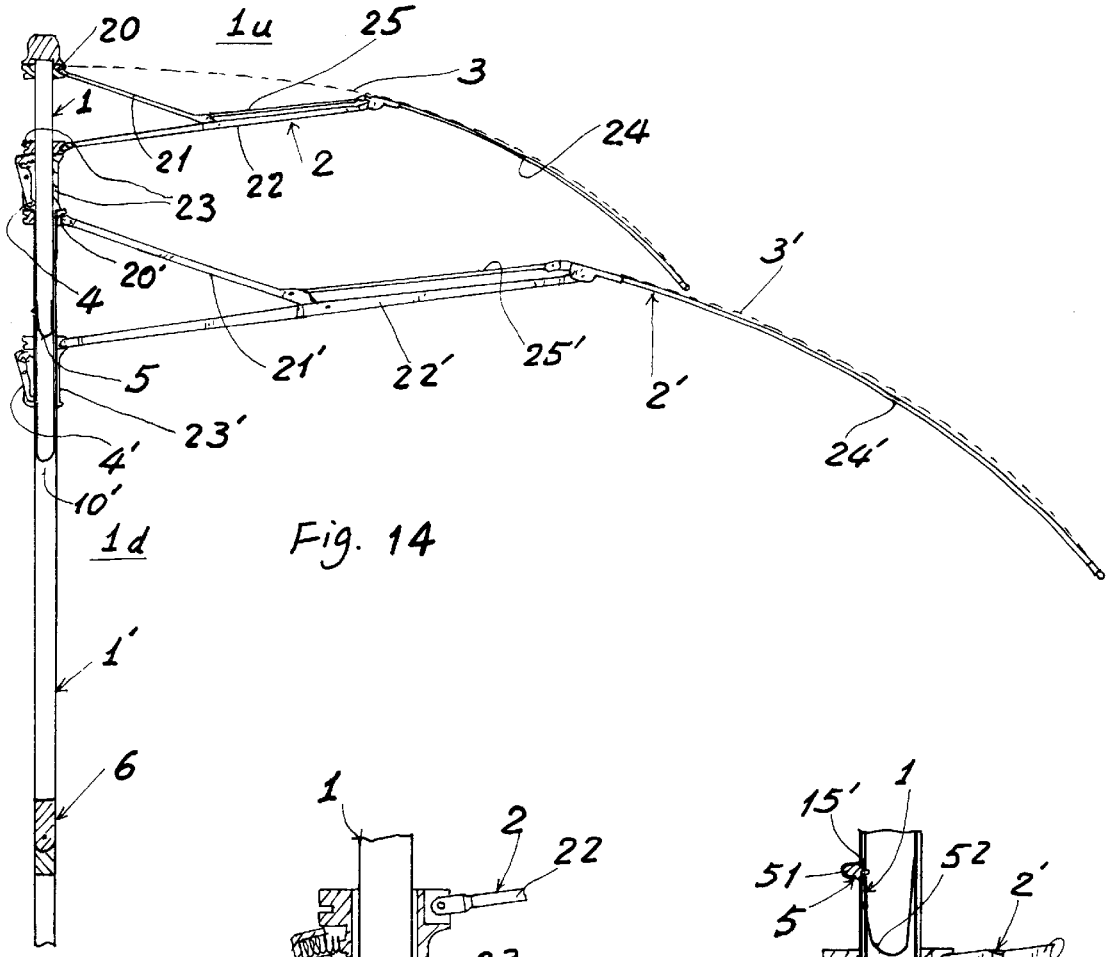
FIG. 14 shows an opened double-story umbrella of the present invention when coupling the upper and lower umbrellas as shown in FIGS. 12, 13.
Figure 15:
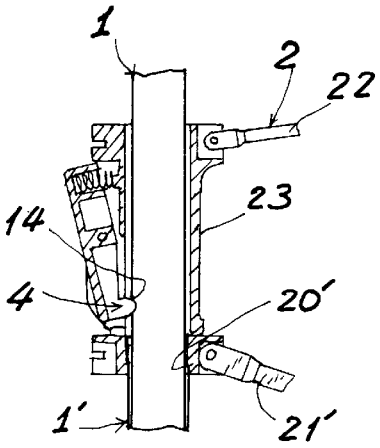
FIG. 15 shows the runner of the upper umbrella with the notch of the lower umbrella of FIG. 14.

The coupling 5 is formed on the upper shaft 1 and includes a coupling latch 51 resiliently urged by a spring 52 to be engaged with a latch hole 15' formed in the lower shaft 1' for coupling the upper shaft 1 on the lower shaft 1' as shown in FIG. 16 when assembling the upper umbrella 1*u* on the lower umbrella 1*d*, whereby upon opening of the upper and lower umbrellas 1*u*, 1*d*, a double-story umbrella is formed as shown in FIG. 14.

Figure 12:
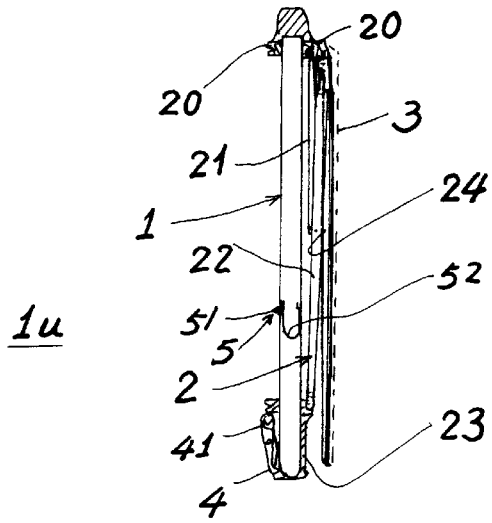
FIG. 12 shows a folded upper umbrella of another preferred embodiment of the present invention.

As shown in FIGS. 17~21, the upper rib assembly 2 is modified from that as shown in FIGS. 12, 14 to be a single fold rather than two folds (FIG. 12); and includes a top rib 21 pivotally secured to the upper notch 20 and a stretcher rib 22 pivotally secured between the top rib 21 and the runner 23 held on the shaft 1.

Figure 22:
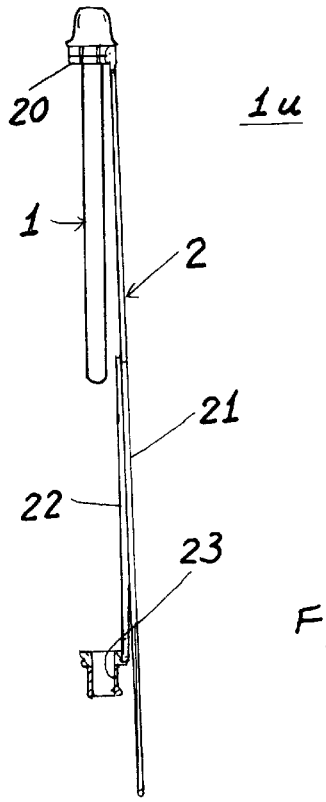
FIG. 22 shows a folded upper umbrella of further preferred embodiment of the present invention.
Figure 23:
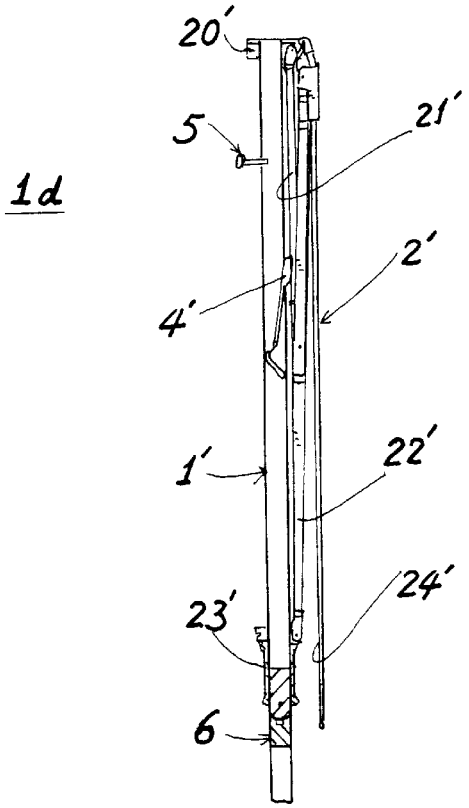
FIG. 23 shows a folded lower umbrella corresponding to the upper umbrella of FIG. 22.
Figure 24:
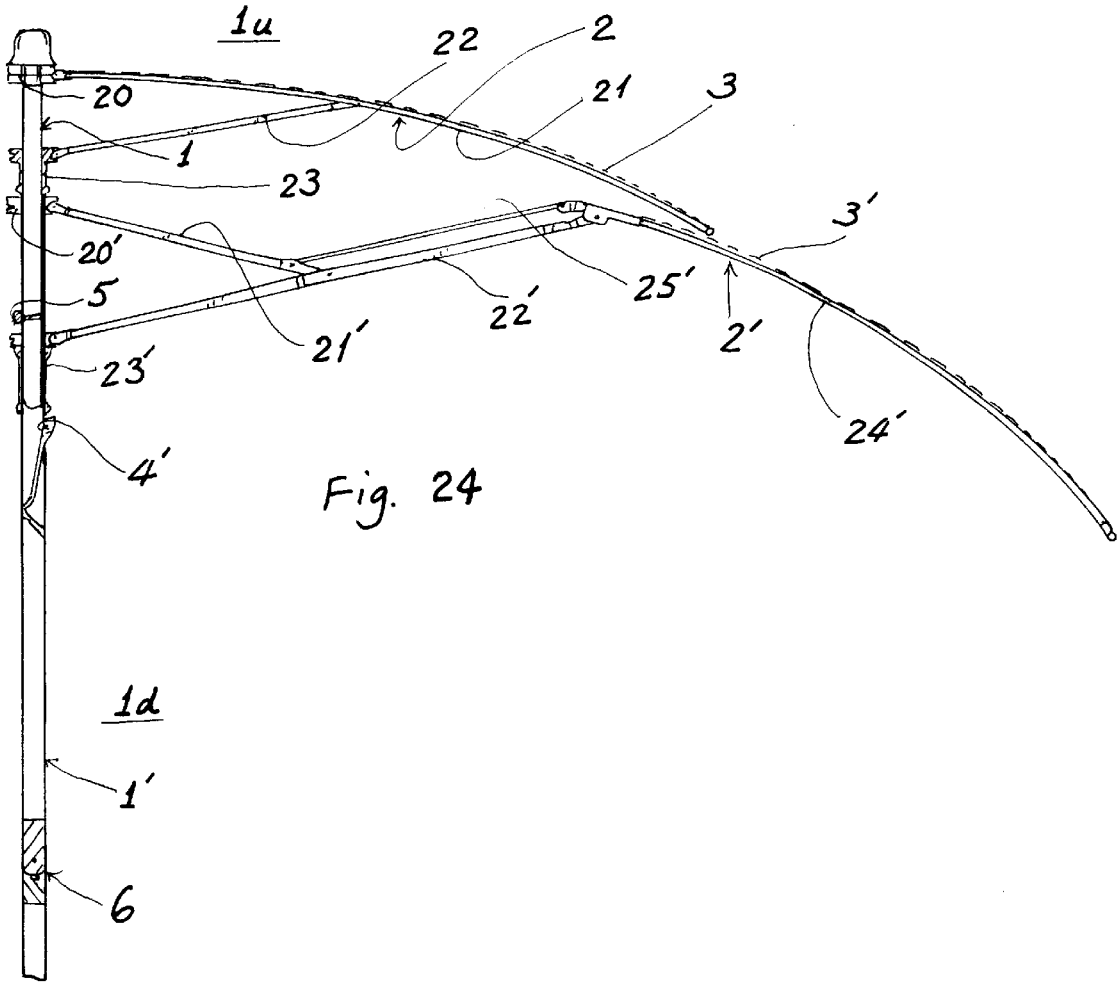
FIG. 24 shows an opened double-story umbrella when coupling the upper and lower umbrellas as shown in FIGS. 22, 23.
Figure 25:
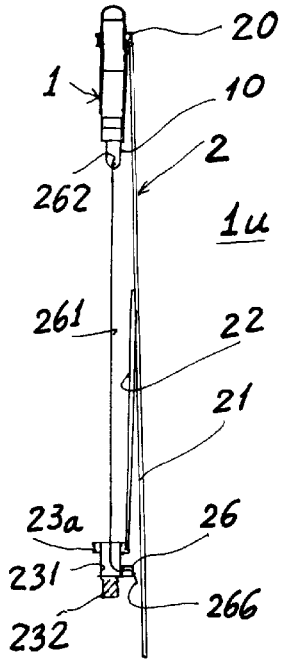
FIG. 25 shows a folded upper umbrella of still further preferred embodiment of the present invention.
Figure 26:
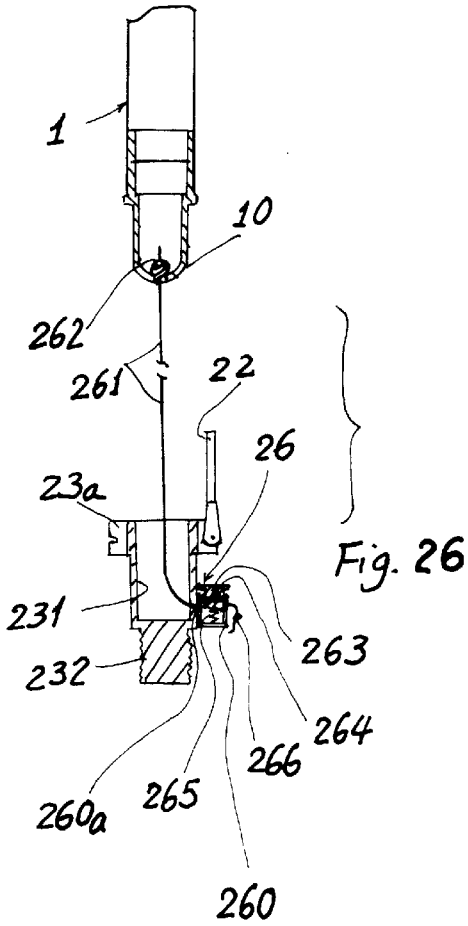
FIG. 26 shows a fastener for fastening the runner of the upper umbrella.

As shown in FIGS. 22~24, the coupling 5 is modified to be a bolt or pin fixed on the lower shaft 1' for engaging a hole formed in the upper shaft 1 for coupling the upper shaft 1 on the lower shaft 1' as shown in FIG. 24.

As shown in FIGS. 25~29, the upper umbrella 1*u* is modified to have the runner 23*a* securable to the upper shaft 1 by a rope fastener 26 formed on the runner 23*a*.

Figure 28:
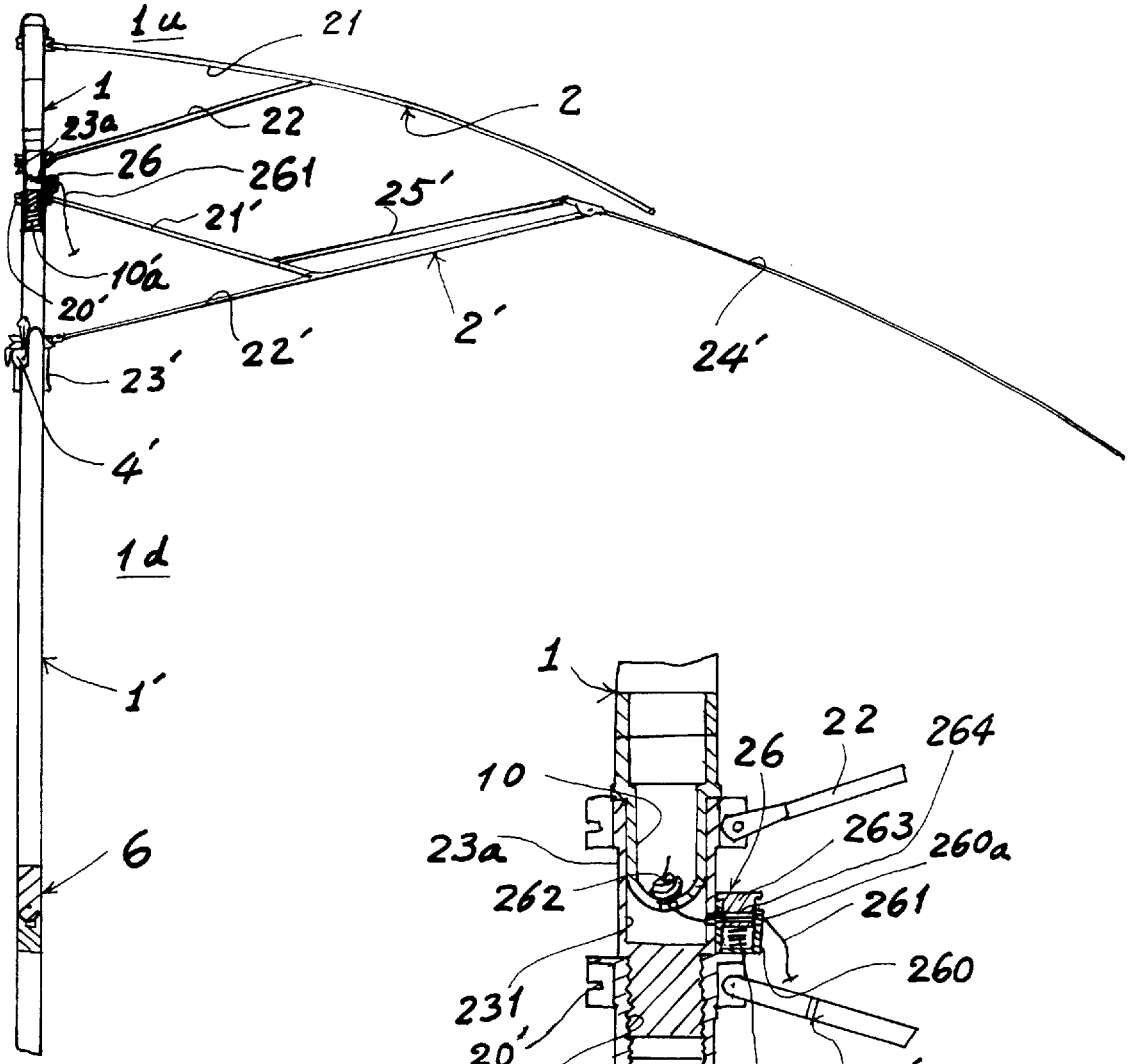
FIG. 28 shows an opened double-story umbrella of the present invention when coupling the upper and lower umbrellas of FIGS. 25, 27.
Figure 29:
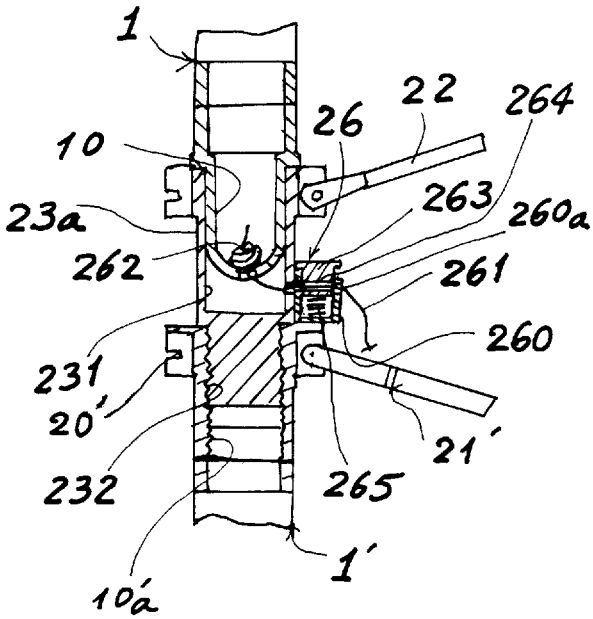
FIG. 29 shows the coupling of the upper and lower umbrellas as enlarged view from FIG. 28.

The runner 23*a* has also been modified to have a hollow portion 231 formed in an upper portion of the runner 23*a* to be engaged with a plug 10 formed on a bottom of the upper shaft 1 when raising the runner 23*a* upon actuating the rope fastener 26 to extend and open the upper rib assembly 2 pivotally secured to the runner 23*a* and the upper notch 20, and a male-threaded portion 232 on a lower portion of the runner 23*a* to be engaged with a female-threaded portion 10'*a* formed in a top end of the lower shaft 1' of the lower umbrella 1*d* for mounting the upper umbrella 1*u* on the lower umbrella 1*d* as shown in FIGS. 28, 29. The rope fastener 26 includes: a rope 261 having an upper end 262 fixed on the plug 10 of the upper shaft 1, a button 263 resiliently held by a restoring spring 265 in a casing 260 formed on the runner 23*a* having a rope hole 264 formed through the button 263, with the rope 261 passing through a pair of side holes 260*a* formed in opposite side walls of the casing 260 and passing through the rope hole 264 in the button 263 and outwardly terminated at an outer end 266, whereby upon depression of the button 263 to coincide the rope hole 264 with the two side holes 260*a* and pulling of the rope 261 outwardly when grasping the outer end 266 of the rope 261, the runner 23*a* is raised upwardly to approximate the plug 10 of the upper shaft 1 until engaging with the plug 10, and the button 263 is then released to allow the restoring spring 265 to urge the button 263 upwardly to unalign the rope hole 264 from the two side holes 260*a* and the rope will be frictionally dogged in between the button 263 and two side walls of the casing 260 for braking and locking the rope 261 and also firmly fastening the runner 23*a* at the bottom of the upper shaft 1 for extending and opening the upper umbrella 1*u* as shown in FIGS. 28, 29.

The upper rib assembly 2 may be single fold or two folds, while the lower rib assembly 2' is preferably made as two folds as illustrated.

Figure 13:
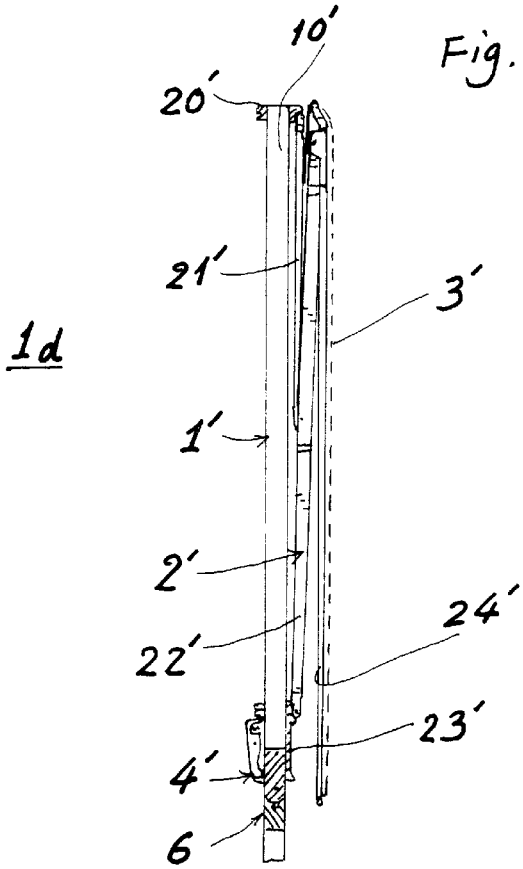
FIG. 13 shows a folded lower umbrella of another preferred embodiment of the present invention.
Figure 27:
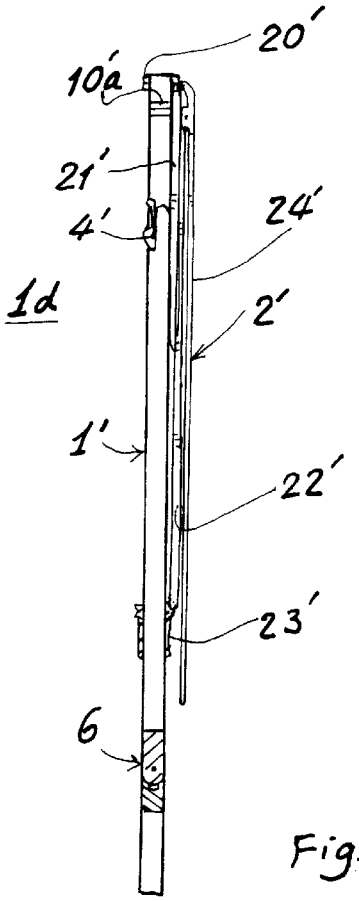
FIG. 27 shows a folded lower umbrella corresponding to the upper umbrella of FIG. 25.

The lower spring catch 4' for locking the lower runner 23' when opening the lower umbrella 1*d* may have plural design choices as shown in FIGS. 2, 13, 27, not limited in this invention. Similarly, the upper spring catch 4 may also have plural design choices.

The present invention may be modified without departing from the spirit and scope of the present invention.

We claim:

1. A double-story umbrella comprising:

an upper umbrella including an upper shaft and an upper rib assembly pivotally secured to said upper shaft having an upper umbrella cloth secured on said upper rib assembly; and a lower umbrella detachably coupled with said upper umbrella, and includes a lower shaft and a lower rib assembly pivotally secured to said lower shaft having a lower umbrella cloth secured on said lower rib assembly, with said lower shaft connected to and positioned under said upper shaft upon coupling of said upper umbrella on said lower umbrella; whereby upon opening of said upper and lower umbrellas, a double-story umbrella is formed; and upon detachment of said upper umbrella from said lower umbrella, said upper and lower umbrellas are each folded for convenient handling and storage.

2. A double-story umbrella according to claim 1, wherein each said rib assembly includes one of a single-fold rib assembly and a multiple-fold rib assembly.

3. A double-story umbrella according to claim 1, wherein each said shaft includes one of a single tube and a plurality of tubes telescopically engageable with one another.

4. A double-story umbrella according to claim 1, wherein said upper umbrella includes at least a top rib pivotally secured to an upper notch on said upper shaft, and a stretcher rib pivotally secured between said top rib and a runner slidably held on said upper shaft.

5. A double-story umbrella according to claim 4, wherein said upper umbrella includes an upper spring catch resiliently formed on said runner to be engaged with a catch slot formed in said upper shaft for locking said runner when opening the upper umbrella.

6. A double-story umbrella according to claim 4, wherein said upper umbrella includes an upper spring catch resiliently secured in said upper shaft for locking said runner when opening the upper umbrella.

7. A double-story umbrella according to claim 4, wherein said upper umbrella further includes a tail rib pivotally secured to said stretcher rib and pivotally secured to said top rib by an auxiliary rib.

8. A double-story umbrella according to claim 1, wherein said lower umbrella includes at least an inner rib pivotally secured to a notch on said lower shaft, and a lower stretcher rib pivotally secured between said inner rib and a lower runner slidably held on said lower shaft.

9. A double-story umbrella according to claim 8, wherein said lower umbrella includes a lower spring catch resiliently formed on said lower runner to be engaged with a catch slot formed in said lower shaft for locking said lower runner when opening the lower umbrella.

10. A double-story umbrella according to claim 8, wherein said lower umbrella includes a lower spring catch resiliently secured in said lower shaft for locking said lower runner when opening the lower umbrella.

11. A double-story umbrella according to claim 8, wherein said lower umbrella further includes a lower tail rib pivotally secured to said lower stretcher rib and pivotally secured to said inner rib by a lower auxiliary rib.

12. A double-story umbrella according to claim 1, wherein said upper umbrella is detachably coupled on said lower umbrella by a coupling selected from a latch, a pin, a screw, a lock, a fastener and a coupling device for mounting said upper shaft on said lower shaft.

13. A double-story umbrella according to claim 12, wherein said coupling is formed on said lower shaft for fastening said upper shaft with said lower shaft.

14. A double-story umbrella according to claim 12, wherein said coupling is formed on said upper shaft for fastening said lower shaft with said upper shaft.

15. A double-story umbrella according to claim 1, wherein said upper shaft is coupled on said lower shaft by male and female threads respectively formed on the corresponding portions of said upper and lower shafts.

16. A double-story umbrella according to claim 1, wherein said lower shaft further includes an angle-adjusting means having an upper member secured to a bottom portion of said lower shaft of said lower umbrella, a lower member pivotally secured to said upper member and secured to a base, a protrusion formed on a bottom of the upper member, and a positioning pad formed on said lower member having a plurality of recesses recessed in said positioning pad each said recess selectively engaging with said protrusion for adjustably angularly erecting said lower shaft above said base and for vertically erecting said lower shaft on said base.

17. A double-story umbrella according to claim 1, wherein said upper and said lower umbrellas form a double-story beach umbrella.

18. A double-story umbrella according to claim 1, wherein said upper umbrella includes a runner operatively secured to said upper shaft by a rope fastener formed on said runner, said runner secured with said upper umbrella having means coupled to said lower shaft for coupling said upper umbrella on said lower umbrella.

19. A double-story umbrella according to claim 18, wherein said runner includes a male-threaded portion formed on a lower portion of said runner and engaged with a female-threaded portion formed in said lower shaft.

20. A double-story umbrella according to claim 18, wherein said rope fastener includes: a rope having an upper end fixed on the plug of the upper shaft, a button resiliently held by a restoring spring in a casing formed on the runner having a rope hole formed through the button, with the rope passing through a pair of side holes formed in opposite side walls of the casing and passing through the rope hole in the button and outwardly terminated at an outer end of said rope, whereby upon depression of the button to coincide the rope hole with the two side holes and pulling of the rope outwardly when grasping the outer end of the rope, the runner is raised upwardly to approximate the plug of the upper shaft until engaging with the plug, and the button is then released to allow the restoring spring to urge the button upwardly to unalign the rope hole from the two side holes and the rope will be frictionally dogged in between the button and two side walls of the casing for braking and locking the rope and firmly fastening the runner at the bottom of the upper shaft for extending and opening the upper umbrella.

* * * * *